United States Patent [19]

Perrella

[11] 4,352,388

[45] Oct. 5, 1982

[54] DIE VENT FOR MOLD CAVITIES

[75] Inventor: Guido Perrella, Senneville, Canada

[73] Assignee: DBM Industries Limited, Lachine, Canada

[21] Appl. No.: 258,850

[22] Filed: Apr. 29, 1981

[30] Foreign Application Priority Data

Jan. 26, 1981 [CA] Canada ..... 369317

[51] Int. Cl.[3] ..... B22D 17/20

[52] U.S. Cl. ..... 164/305; 164/410; 425/420

[58] Field of Search ..... 164/305, 410; 425/420, 425/812

[56] References Cited

U.S. PATENT DOCUMENTS

| | | | |
|---|---|---|---|
| 1,261,509 | 4/1918 | Getman | 164/305 X |
| 2,971,230 | 2/1961 | Coleman et al. | 164/305 |
| 3,349,833 | 10/1967 | Hodler | 164/305 X |
| 3,357,057 | 12/1967 | Bucy | 164/305 X |
| 3,433,291 | 3/1969 | Hodler | 164/305 |
| 3,602,289 | 8/1971 | Barrett | 164/410 X |
| 3,885,618 | 5/1975 | Hodler | 164/305 |
| 3,892,508 | 7/1975 | Hodler | 164/305 X |
| 3,991,971 | 11/1976 | Drake | 164/410 X |
| 4,027,726 | 6/1977 | Hodler | 164/305 |
| 4,060,122 | 12/1980 | DiRosa | 164/305 X |

FOREIGN PATENT DOCUMENTS 2751431 5/1979 Fed. Rep. of Germany .

*Primary Examiner*—Gus T. Hampilos
*Assistant Examiner*—J. Reed Batten, Jr.
*Attorney, Agent, or Firm*—Beveridge, DeGrandi and Kline

[57] ABSTRACT

A device as disclosed for operation with mold or die cavities of a die casting machine or injection molding machine for venting the cavity to allow gas therein to escape from the cavity when it is being filled with molten metal or the like. The body of the device includes a plurality of passageways providing communication between the die cavity and the atmosphere.

1 Claim, 7 Drawing Figures

DIE VENT FOR MOLD CAVITIES

BACKGROUND OF THE INVENTION

This invention relates to die casting or injection molding and in particular to a device for venting the cavities of the molds in such machines during the operative cycles thereof to reduce as much as possible the porosity in the finished castings or molded articles.

In the operation of a die casting machine for example, molten zinc or other casting metal is shot into the mold cavity of the machine and the molten metal has to displace air or other gases in the cavity. Conventionally, gas is allowed to escape from the cavities through the provision of a plurality of small channels provided along the parting line of the dies and positioned at locations where the entrapment of gas is most likely to take place. However, conventional methods have not been entirely successful in reducing porosity in the finished castings caused by air or other gases entrapped in the cavity when the molten metal solidifies.

There have been some attempts to improve on the abovementioned conventional method by providing some form of venting apparatus where a valve in the apparatus remains open while the gas in the cavity escapes, being pushed out by the advancing molten metal. When the metal enters the device the valve is closed. One example of this is shown in German Offenlegungsschrift 27 51 431 to Fritz Hodler or in U.S. Pat. No. 3,885,618 to Hodler. Still further examples of ventilation ducts in molding machines are to be found in U.S. Pat. Nos. 3,892,508 of July 1st, 1975, 3,433,291 of Mar. 18th, 1969, 3,349,833 of Oct. 31st, 1967, 2,971,230 of Feb. 14th, 1961 and U.S. Pat. No. 3,991,971 of Nov. 16th, 1976.

All of the abovementioned devices include at least several moving parts which, in time, wear out and fail to perform as designed. Moreover, because of the moving parts, the manufacturing costs are substantial.

The present invention provides a substantial advance in the art by providing a device which permits a substantially larger venting of mold cavities over and above conventional vending means and in which no moving parts are used.

SUMMARY OF THE INVENTION

In accordance with a broad aspect, the present invention relates to a device for venting a mold cavity and comprises a body which is adapted for mounting and a die block of a die casting or injection molding machine. The body has an entrance end in communication with the mold cavity and an exit end which is open to the atmosphere so as to allow gas in the cavity to escape to the atmosphere when the cavity is being filled with casting metal or the like. The body includes a plurality of vent strips or plates joined together in face to face relation and secured in that position. Each strip or plate has a narrow portion along most of its upper edge which, when the vents are all joined together, provides a plurality of longitudinal gaps extending substantially the length of the body. A longitudinal recess is also provided along each strip or plate just below the narrow upper portion and is therefore in communication with the gap between adjacent plates as well as the entrance and exit ends of the body. The upper surfaces of the strips have a progressively narrowing taper from the entrance end of the body towards the end of the gaps between the strips. This taper provides a channel on the surface of the body to communicate with a similar channel in a die block in which the body is mounted.

The tapered portion on the upper surface of the body narrows progressively towards the exit end and, as the over flow metal from the cavity extends along the channel interconnecting the vent body with a cavity it pushes ahead of it the gases which escape down through the longitudinally extending gaps in the body and out through the exit to the atmosphere.

If the molten metal reaches the vent body, its relative width made up by the plurality of plates and its gradually narrowing taper, puts the molten metal over a relatively large area of gradually thinning proportion which accelerates the cooling of the overflow. When the dies are opened and the part ejected this overflow portion is of course removed with the cast part.

The venting device of this invention may be used in conjunction with a vacuum and reverse blow arrangement in which approximately 500 millimeters of vacuum can be used to assist in cleaning out the mold cavity during the short period when the dies are closed before a shot is made. The vacuum and reverse blow apparatus can be helpful in the abovementioned operation but it is not necessary for the successful operation of this invention.

The invention is illustrated by way of example in the accompanying drawings in which.

DESCRIPTION OF THE PREFERRED EMBODIMENT

Figure 1:
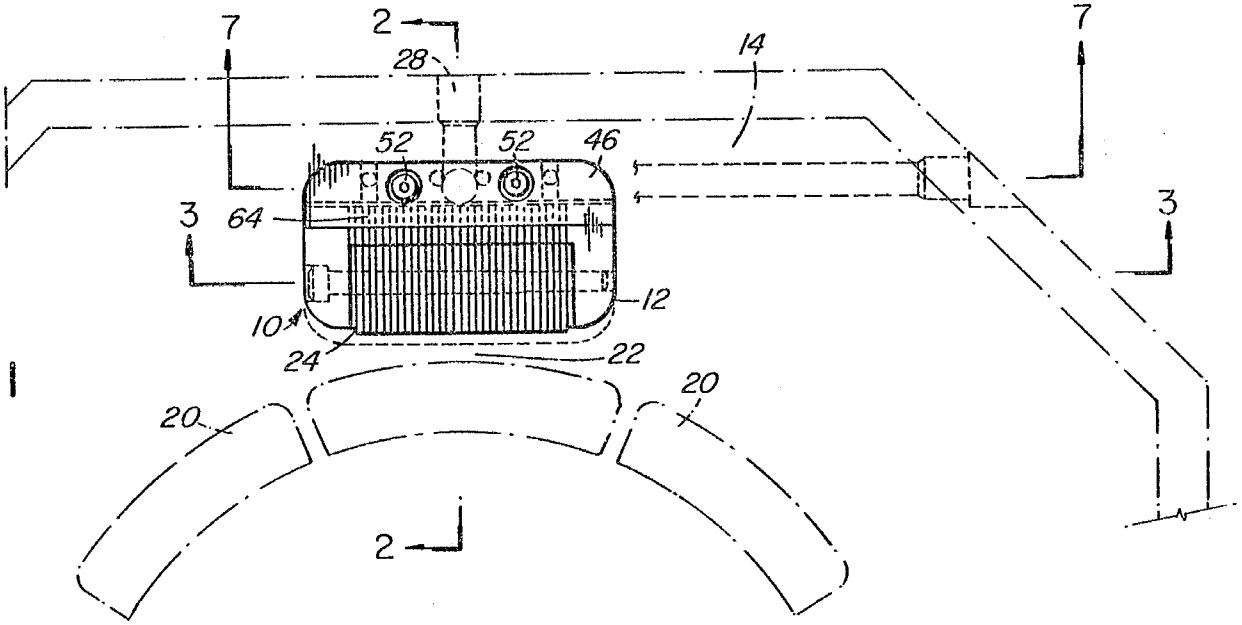
FIG. 1 is a plan view of the cavity venting apparatus in a die block.
Figure 3:
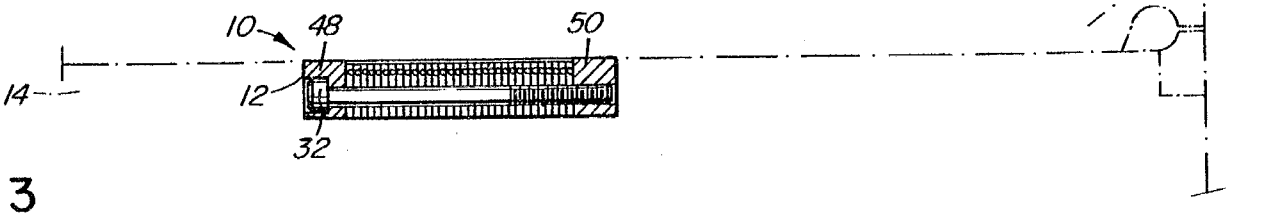
FIG. 3 is a further sectional view of the apparatus taken along the lines 3—3 of FIG. 1.
Figure 2:
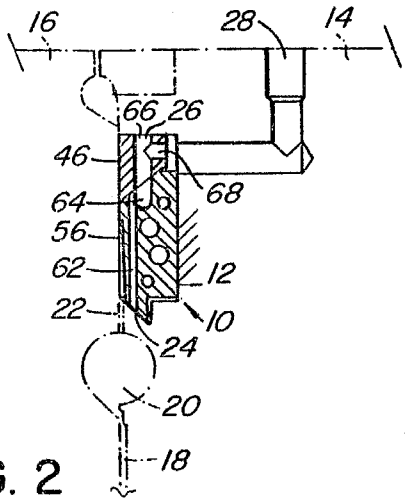
FIG. 2 is a sectional view of the apparatus taken along the lines 2—2 of FIG. 1.

Referring to FIGS. 1, 2 and 3, the venting apparatus generally indicated at 10 is mounted in a pocket 12 in a die block 14 which, together with an opposing die block 16 of a die casting machine or the like forms a cavity 18 into which molten metal is injected to form a casting. Cavity 18 may include a series of overrun traps 20 adapted to receive excess molten material from the cavity when the shot therein is made. The cavity 18 and overrun trap 20 are in communication with the venting apparatus 10 through a channel 22 shown in FIGS. 1 and 2. Briefly, when a shot of molten material is made into the cavity 18 the advancing head of metal pushes any gases in the cavity outwardly through the overrun trap 20 and channel 22 into the vent 10 via its entrance end 24, the air escaping through the exit end 26 of the vent and through an outlet 28 to the atmosphere.

Figure 6:
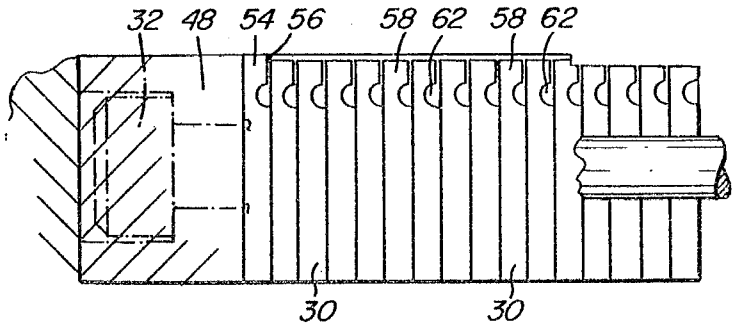
FIG. 6 is a further cross-sectional view taken along the lines 6—6 of FIG. 4.
Figure 7:
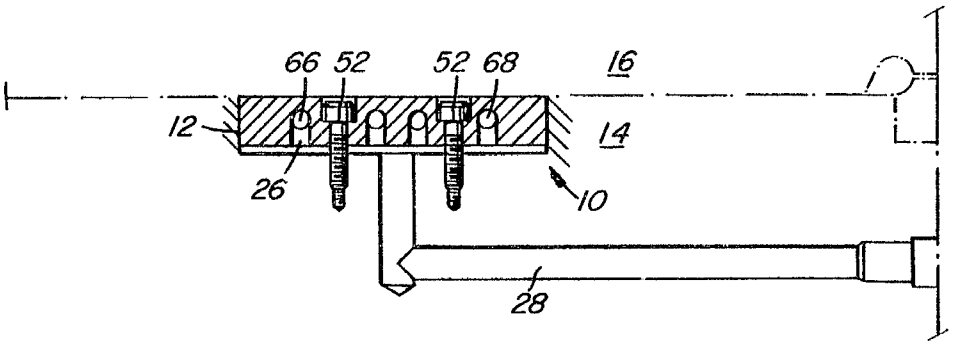
FIG. 7 is a cross-sectional view taken along the lines 7—7 of FIG. 1.
Figure 5:
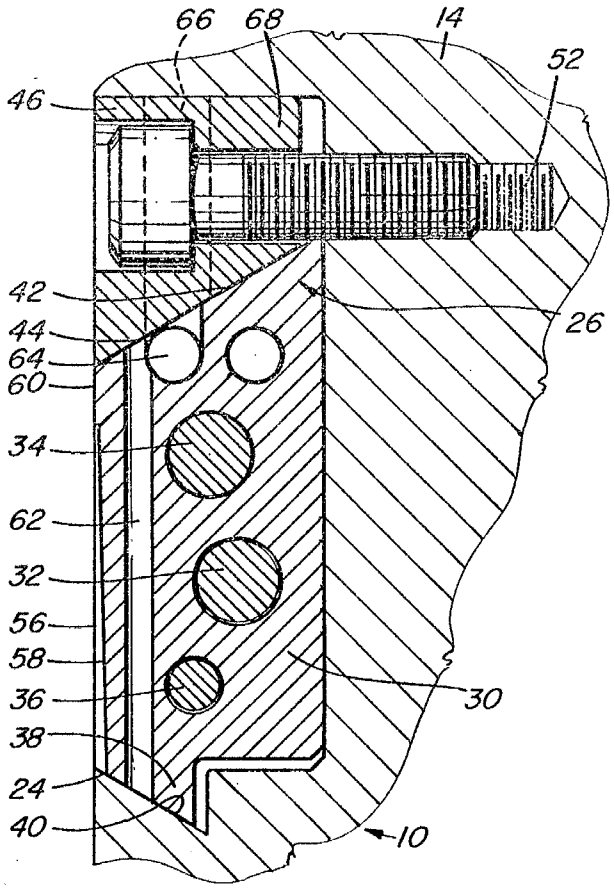
FIG. 5 is a cross-sectional view taken along the lines 5—5 of FIG. 4.
Figure 4:
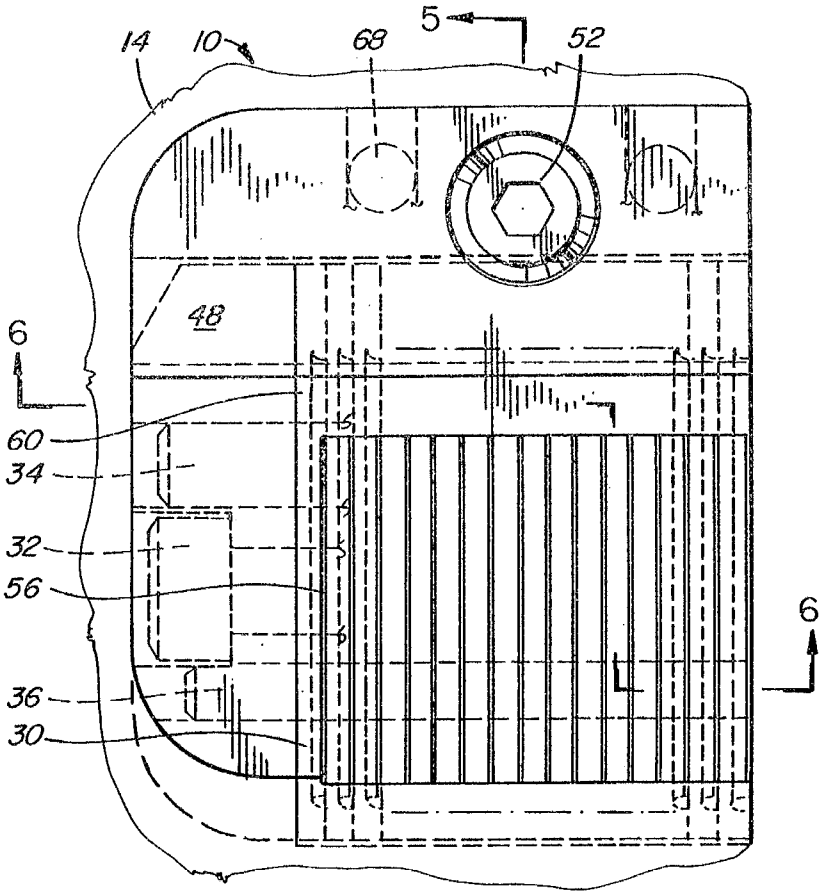
FIG. 4 is an enlarged view of part of the apparatus shown in FIG. 1.

Referring to FIGS. 4, 5 and 6, the vent body 10 is made up of a plurality of vent strips or plates 30 mounted together in face to face contact and secured in that position by a long fastening member 32 extending through apertures provided for that purpose in the strips, and by a pair of spaced locating pins 34, 36 as seen in FIG. 4.

FIG. 5 shows that the plates or vent strips 30 have a lip portion 38 the angled face 40 of which engages a similarily angled face in the pocket 12 of the die block 14. The other end of the plate 30 has an angled face 42 which matches a similarily angled face 44 in a clamping block 46. The cross bolt 32 clamps the plates 30 together along with left and right hand end blocks 48 and 50 and, together with the pressure applied to the vent body 10 by the clamping block 46 and its two cap screws 52, the vent is held securely and accurately positioned in the die block.

As seen in FIG. 6, each of the vent strips or plates 30 has an upper edge 54 which is somewhat narrower than the lower part of the plate and as this narrowness is taken along one upper side only of each plate 30 there is a plurality of gaps extending across the upper face of the vent body 10, one between each plate. As an example, these gaps are approximately 0.002 of an inch in width. As seen in FIGS. 4 and 5, the gaps 56 do not extend the full width of the body but extend to a point just short of the exit end 26 thereof. It will also be seen from FIG. 5 that the upper surfaces 58 of the plates 30 are tapered so that, at the entrance end 24, the top surface 58 is noticeably below the adjacent surface of the die block. The taper narrows throughout the length of the body until, just short of the exit end, the taper ends so that the upper surface 60 at that location is flush with the top of the die block 14.

Just below the gaps 56 on each plate is a recess 62 which extends the full length of the upper part of each plate from the entrance end 24 through to the exit end 26 and, at this latter position, each recess 62 communicates with a cross channel 64 which in turn communicates with channels 66 and 68 which interconnect with the vent outlet 28. It will be appreciated that gas coming from the cavity 18 through the channel 22 is pushed by the oncoming head of molten metal so that the gases exit downwardly through the narrow gaps 56 into the recesses 62 and out through the vent outlets 28 via the passages 64, 66 and 68.

The channel 22 is relatively wide as shown in FIG. 1, the overflow of metal engages the top of the vent in a large surface area which, as the metal moves along the tapered surface, grows progressively smaller so that the metal entering this area cools much faster, the gas escaping therebelow.

While the invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not of limitation, and there is no intention in the use of such terms and expressions to exclude any equivalents of the features shown and described or portions thereof, but it is recognized that various modifications are possible within the scope of the invention claimed.

The embodiments of the invention in which an exclusive property or privilege is claimed are defined as follows:

1. A device for venting a mold cavity comprising a body adapted for mounting in a die block and having an entrance end in communication with said mold cavity and an exit end open to the atmosphere to allow gas in said cavity to escape to the atmosphere when the cavity is being filled with casting metal or the like, said body comprising a plurality of vent strips joined together in face to face relation, each strip having a narrow portion along most of its upper edge to provide a plurality of longitudinal gaps extending substantially the length of said body; a longitudinal recess along each strip in communication with said gap and the entrance and exit ends of said body; and the upper surfaces of said strips having a progressively narrowing taper from the entrance end of the body to the end of the gaps between said strips, said taper providing a channel on the surface of the body to communicate with a similar channel in a die block in which the body is mounted.

* * * * *